United States Patent [19]

Marchetti

[11] Patent Number: 4,551,194

[45] Date of Patent: Nov. 5, 1985

[54] TAPING MACHINE FOR CARTONS OF VARIABLE WIDTH

[76] Inventor: Augusto Marchetti, Piazza Sicilia, 7 - 20146 Milano, Italy

[21] Appl. No.: 694,630

[22] Filed: Jan. 24, 1985

[30] Foreign Application Priority Data

Jan. 26, 1984 [IT] Italy ..... 19326 A/84

[51] Int. Cl.[4] ..... B65B 7/16

[52] U.S. Cl. ..... 156/468; 53/137; 198/627

[58] Field of Search ..... 156/486, 468; 53/137; 198/627, 726

[56] References Cited

U.S. PATENT DOCUMENTS

| | | | |
|---|---|---|---|
| 2,316,654 | 4/1943 | Stover | 198/627 X |
| 2,332,672 | 10/1943 | Schmitt | 198/627 X |
| 3,491,657 | 1/1970 | Feigel | 53/137 X |
| 3,598,227 | 8/1971 | Stanford | 198/627 X |
| 3,623,293 | 11/1971 | Boulay | 53/137 X |
| 4,161,138 | 7/1979 | Marchetti | 53/137 X |

*Primary Examiner*—David Simmons

*Attorney, Agent, or Firm*—Cushman, Darby & Cushman

[57] ABSTRACT

The machine has a pair of belt-driven conveying units, which may be approached from opposite sides to the carton sides. For said units there is provided a displacing, guiding and driving system, which is simple and of reduced size and allows a very good engagement of the belts with the carton sides, particularly making easier the inlet and the outlet of the same cartons.

4 Claims, 3 Drawing Figures

1
3
4
5
6
7
8
9
10
11
12
13
14
15
16
17
18
19
20
21
22
23
24
29
30
31
40
41
69
III

TAPING MACHINE FOR CARTONS OF VARIABLE WIDTH

The present invention relates to a taping machine adapted for use with cartons of variable width.

There are known so called "self-sizing" taping machines, which, in order to operate on cartons of variable width, include conveying units with driven belts, which extend along two opposite sides of a carton support base and, during working, may be approached to each other up to perform a conveying engagement with the carton sides.

Object of the present invention is to realize a combined displacing, guiding and driving system for conveying units of the above said type, which shows itself particularly useful and efficient in relation to the intended use of the taping machine.

In view of this object, the taping machine according to the present invention, comprising a carton support base and a pair of driven-belt conveying units mounted on said support base and mutually approachable from opposite sides to perform a conveying engagement with the carton sides, is characterized in that said conveying units are mounted on said support base at their outlet ends and at portions advanced with respect to their inlet ends, said outlet ends being rotatably mounted on respective belt driving shafts, which vertically project from conical groups for motion transmission, which are slidingly mounted on a horizontal driving shaft extending transversally with respect to said support base, and said advanced portions being fixed to respective support sleeves slidingly mounted on at least one transversal guiding bar, and there is provided a displacing device for the conveying units, which is arranged at the inlet ends of said units and comprises a slidable body with horizontal axis and rack-shaped opposite sides, control means for the sliding of said body, a pair of toothed sectors rotatable about vertical axes and engaged with said rack-shaped sides of said body to transform the horizontal sliding of the latter into corresponding opposite rotations of said toothed sectors, and kinematic connecting means which extend horizontally along said support base to connect kinematically said toothed sectors to said sliding sleeves in order to convert said opposite rotations of said toothed sectors into a corresponding movement of mutual approach or moving away of said conveying units.

It is important to note that, thanks to the above indicated mounting and driving systems, the two conveying units act on the cartons to be taped with a certain flexibility, which allows at any moment the most suitable engagement of the belts with the carton sides. More precisely, due to the advanced location of the point of action of the displacing device of the conveying units with respect to their inlet ends, the advanced portions of the conveying units are still urged in the direction of mutual approach when the inlet ends of the same units are already engaged with the sides of an incoming carton. Also thanks to the pivoting engagement of the outlet ends of the same units on the conical groups which transfer the motion to the belts, the two conveying units therefore put themselves in a slightly converging position which makes maximum the engagement of the belts with the initial part of the carton sides and, consequently, makes easier the introduction of the same carton. Once the carton has been fully introduced, on the other hand, the two conveying units come back to the parallel condition, from which they slightly diverge subsequently during the carton ejection, when their outlet ends are still retained by the carton sides while their backward portions are forced to approach by the rearly arranged displacing device.

The functional result is thus very good, while the system in its entirety is certainly simple and the size of the displacing device of the conveying units is made very limited by the horizontal extension of its parts.

An embodiment of the machine according to the invention is shown for better clarity in the enclosed drawings, in which.

Figure 1:
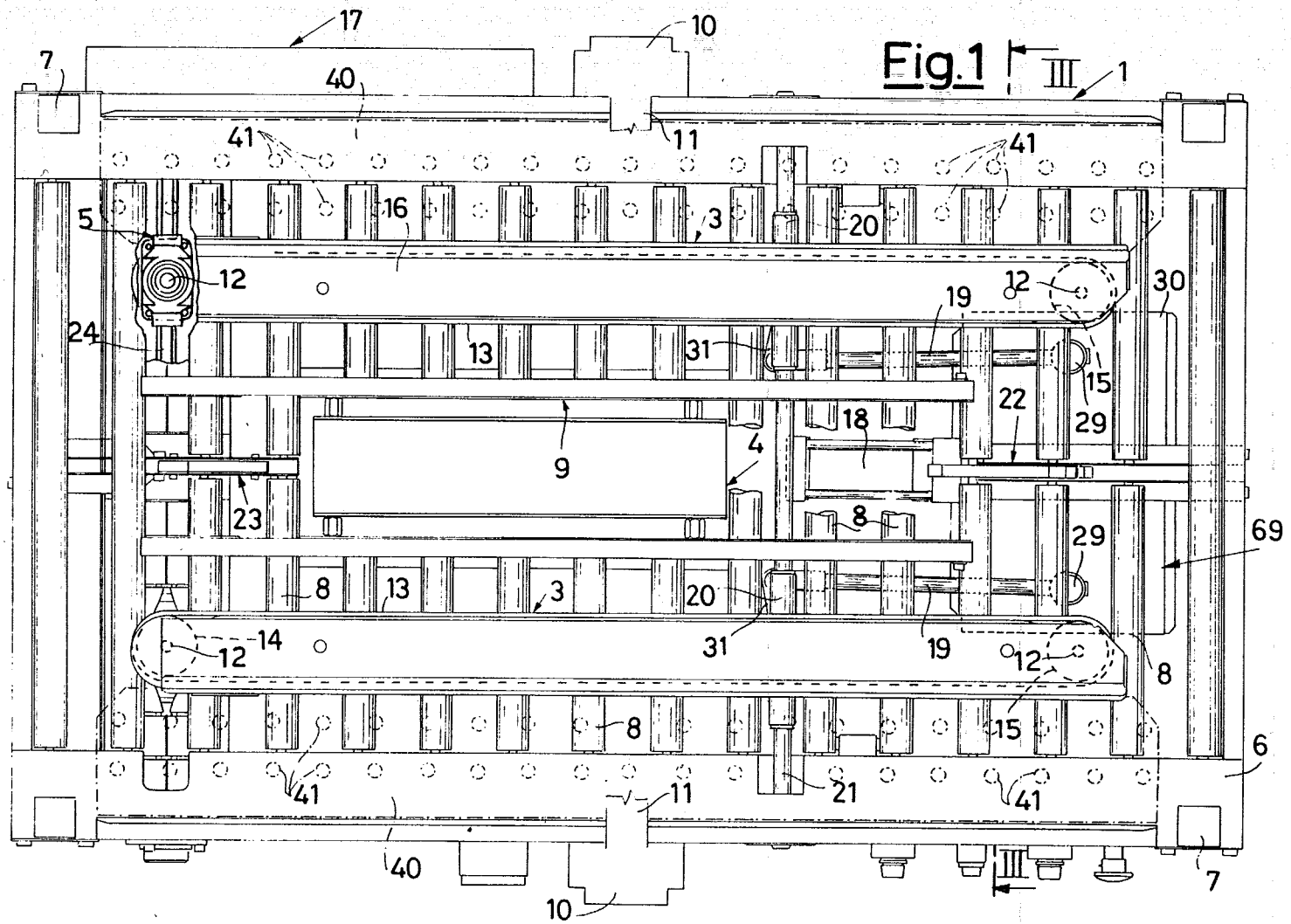
FIG. 1 shows a top plan view, with removed parts, of a self-sizing taping machine according to the present invention.

The self-sizing taping machine shown in the drawings generally comprises a support and advancement base or bed 1 for the cartons to be taped, two belt-type conveying units 3 arranged at the two sides of said support base and approachable to each other to engage the carton sides for the rectilinear advancement of the cartons from one end to the other end of said support base (from right to left, looking at FIG. 1), a lower taping head 4 for applying an adhesive sealing tape to the bottom wall of the cartons and an upper taping head (not shown) for applying an adhesive sealing tape to the carton top.

The base 1 is formed by a rectangular frame 6 with legs 7, which rotatably supports a succession of idle transversal rollers 8, which define the support plane for the cartons. At the center of this succession of rollers there is defined a rectangular space 9 (FIG. 1), in which the lower taping head 4 is inserted and fastened.

From the two sides of the base 1 there extend upwardly two box-like columns 10, which slidingly support the two ends of a cross-member 11, on which the upper taping head is mounted. Two pneumatic cylinders (not shown) provide for the lifting of the cross-member, when appropriate.

Figure 3:
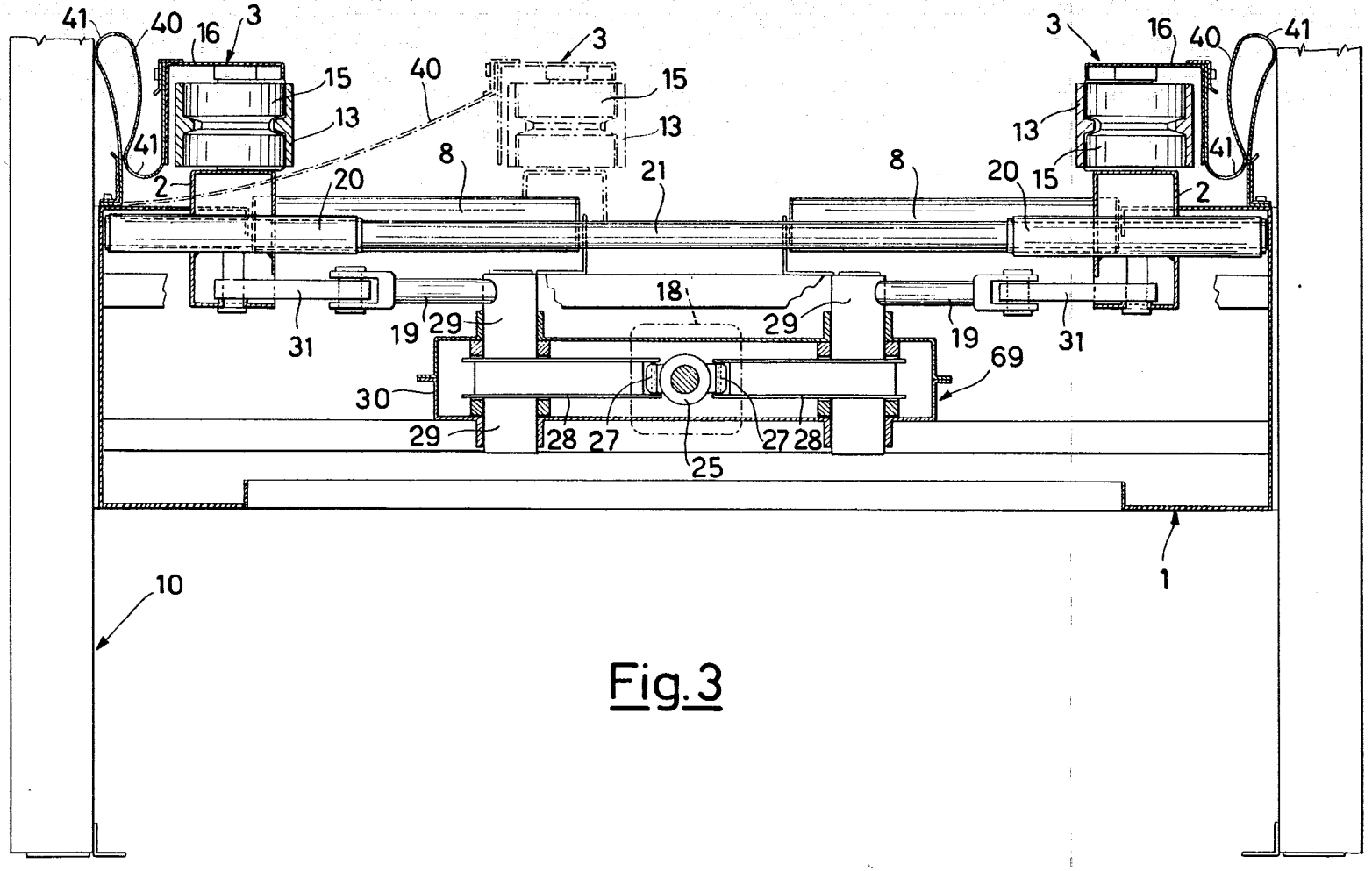
FIG. 3 shows said machine in cross-section along line III—III of FIG. 1, with the conveying units in position of maximum mutual moving away.

The two conveying units 3 are of the per-se-known type consisting of a conveying belt 13 stretched in closed loop between two end pulleys 14 and 15, respectively driving and idle, inside a support and protection structure formed by a lower base 2 and by an upper case 16 (FIG. 3).

Everyone of the two driving pulleys 14, which define the outlet ends of the conveying units, rotates integrally with a vertical shaft 12, which constitutes the outlet shaft of a conical group 5 for motion transmission, which is slidingly mounted on a horizontal driving shaft 24 with polygonal cross-section, which extends transversally with respect to the conveying units 3 and receives the motion from a motor assembly generally designated with 17 in FIG. 1. The conical group 5 is of per-se-known type and, therefore, is not described and shown in detail herein.

Everyone of the idle pulleys 15, in its turn, is rotatably mounted on a pivot (not shown) fixed to the lower base 2 of the support and protection structure.

An advanced portion of said structure (with respect to the inlet ends defined by the idle pulleys 15) is finally fixed to an underlying support sleeve 20, which is slidingly mounted on a transversal guiding bar 21.

Figure 2:
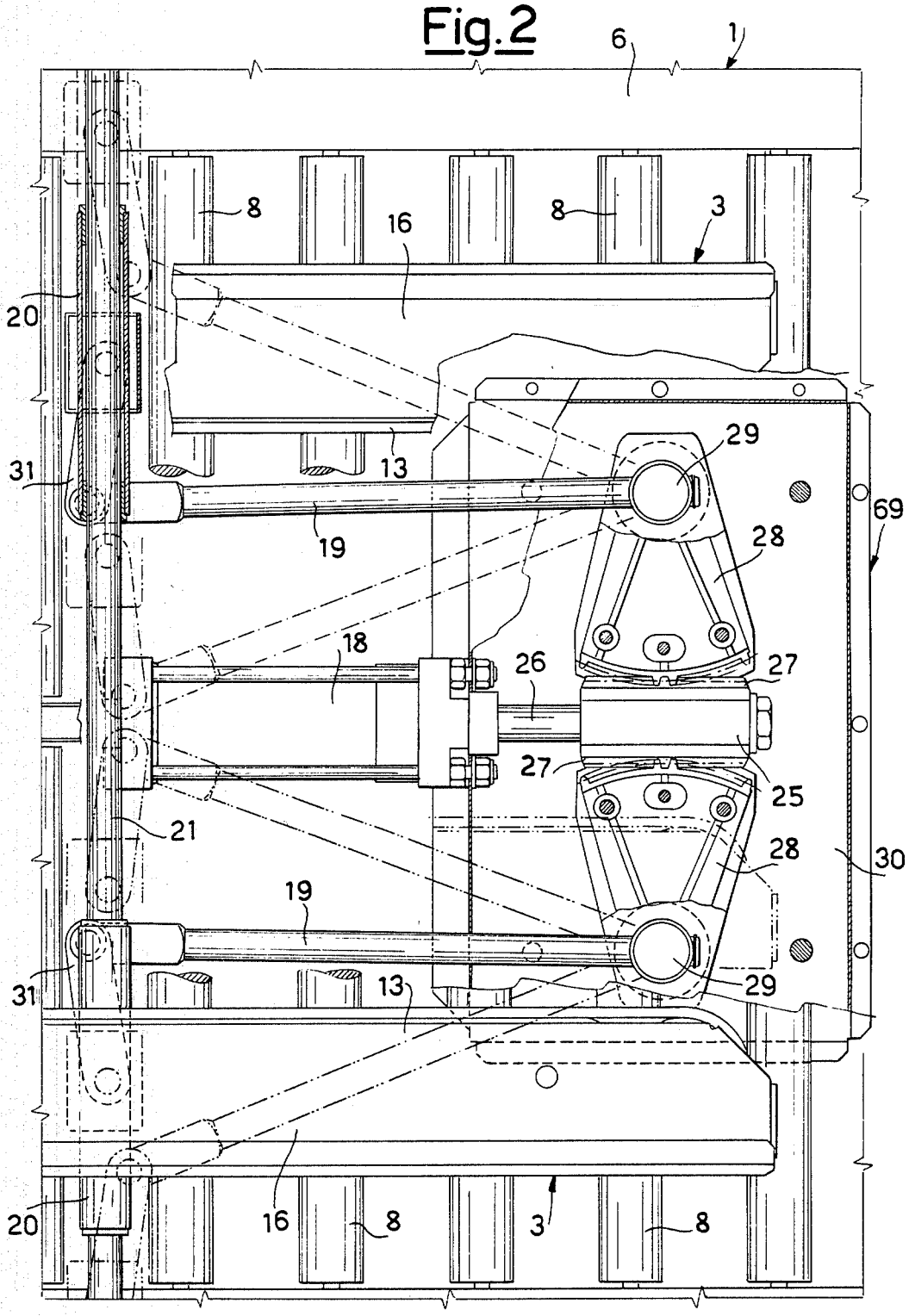
FIG. 2 shows, still in top plan view, the enlarged detail of the displacing device of the conveying units, which is comprised in said machine.

The mutual displacement of the conveying units 3 is controlled by a driving device 69, whose constructional details are evidenced in FIGS. 2 and 3. Said device comprises a slidable body 25 mounted on the piston rod 26 of a pneumatic cylinder 18 with horizontal axis and provided with rack-shaped opposite sides 27, with which two opposite toothed sectors 28 provided of rotation pivots 29 rotatably supported by a support and housing box 30 cooperate. To said pivots are made integral respective horizontal arms 19, which together with links 31 constitute kinematic connecting means between the rotating toothed sectors 28 (arranged at the inlet ends of the conveying units 3) and the sliding sleeves 20 (arranged at said advanced portions of the same conveying units). The rotary motion of the toothed sectors 28, controlled by the cylinder 18, is thus converted into a translatory motion of the conveying units 3 between the two positions of maximum mutual approach and maximum mutual moving-away, which are illustrated in dash-dot lines in FIG. 2.

Two sheets 40 of flexible plastic material with lightening bores 41 (FIGS. 1 and 3) are arranged for connection of the protection cases 16 of the conveying units 3 with the fixed frame of the machine in order to "cover" spaces of possible danger for hands of an imprudent operator. The flexibility of said sheets 40, on the other hand, allows the free displacement of the conveying units 3 from the position of maximum moving-away to that of maximum approach (and viceversa), as illustrated in solid line and in dash-dot line in FIG. 3.

As shown in FIG. 1, there are finally provided two lever-type sensing members 22 and 23, which are respectively arranged at the inlet and the outlet of the sealing area defined by the conveying units 3 and the two taping units. Said sensing members causes the following automatic operation of the machine shown in the drawings, particularly of the two conveying units 3 and of the corresponding driving device 69.

The carton to be taped is introduced on the support plane 1 with the conveying units in position of maximum mutual moving away and is then manually caused to advance up to a prefixed position sensed by the sensing lever 22 (FIG. 1). Omitting the simultaneous behaviour of the upper taping head, which is not interesting for the present invention, the operation of the sensing lever 22 causes (according to another simultaneous patent application of the present Applicant) the extension of the pneumatic cylinder 18, which urges a translatory movement of mutual approach of the conveying units 3, at their advanced portions superimposed to the sleeves 20, through the rack body 25, the rotatable toothed sectors 29, the rigid arms 19 and the links 31. The conveying units thus reach the position of engagement with the carton sides, for example that indicated in solid line in FIG. 2, as well as in FIG. 1.

Since the carton is still in the introduction step and, on the contrary, the points of action of the approaching force for the conveying units are advanced with respect to the same carton, however, the conveying units exploit the pivotment provided at the outlet ends on the shafts 12 to put themselves in a slightly converging position, which improves the engagement of the belts 13 (already driven) with the carton sides and thus makes easier the complete introduction of the carton.

While the advancement of the carton goes on, the conveying units 3 return on the contrary to an exactly parallel position, thereby offering the maximum extension of the belts to the engagement with the carton sides.

At the outlet from the sealing area, on the other hand, a contrary movement occurs, that is the backward position of the points of action of the approaching force with respect to the outlet ends of the conveying units obliges the latter to put themselves in a slightly diverging position, which makes easier the ejection of the carton.

The passage of the carton on the sensing lever 23 finally causes (according to the above said simultaneous patent application of the same Applicant) the shortening of the cylinder 18 for the return of the conveying units 3 to the position of maximum mutual moving away.

I claim:

1. Taping machine for cartons of variable width, comprising a carton support base and a pair of driven-belt conveying units mounted on said support base and mutually approachable from opposite sides to perform a conveying engagement with the carton sides, characterized in that said conveying units are mounted on said support base at their outlet ends and at portions advanced with respect to their inlet ends, said outlet ends being rotatably mounted on respective belt driving shafts, which vertically project from conical groups for motion transmission, which are slidingly mounted on a horizontal driving shaft extending transversally with respect to said support base, and said advanced portions being fixed to respective support sleeves slidingly mounted on at least one transversal guiding bar, and there is provided a displacing device for the conveying units, which is arranged at the inlet ends of said units and comprises a slidable body with horizontal axis and rack-shaped opposite sides, control means for the sliding of said body, a pair of toothed sectors rotatable about vertical axes and engaged with said rack-shaped sides of said body to transform the horizontal sliding of the latter into corresponding rotations of said toothed sectors, and kinematic connecting means which extend horizontally along said support base to connect kinematically said toothed sectors to said sliding sleeves in order to convert said opposite rotations of said toothed sectors into a corresponding movement of mutual approach or moving away of said conveying units.

2. Machine according to claim 1, characterized in that said control means consist of a pneumatic cylinder horizontally extending along said support base between said slidable body and said sleeves.

3. Machine according to claim 1, characterized in that said kinematic connecting means comprise a pair of arms made integral with said toothed sectors and horizontally extending towards said sleeves, and a pair of connecting links between said arms and said sleeves.

4. Taping machine for cartons of variable width, comprising a carton support base and a pair of belt-driven conveying units mounted on said support base and mutually approachable from opposite sides to perform a conveying engagement with the carton sides, characterized by comprising sheets of flexible material arranged for connection of said conveying units with respective sides of said support base for safely covering the corresponding interposed spaces.

* * * * *